US008547293B2

(12) United States Patent
Van Lieshout et al.

(10) Patent No.: US 8,547,293 B2
(45) Date of Patent: Oct. 1, 2013

(54) SYSTEM AND METHOD FOR IDENTIFICATION OF DISPLAYS

(75) Inventors: Petrus Johannes Gerardus Van Lieshout, Beek en Donk (NL); Hjalmar Edzer Ayco Huitema, Veldhoven (NL); Maarten Peter Bodlaender, Eindhoven (NL); Nicolaas Willem Schellingerhout, Veldhoven (NL)

(73) Assignee: Creator Technologies B.V., Breda (NL)

( * ) Notice: Subject to any disclaimer, the term of this patent is extended or adjusted under 35 U.S.C. 154(b) by 1242 days.

(21) Appl. No.: 11/995,480

(22) PCT Filed: Jul. 7, 2006

(86) PCT No.: PCT/IB2006/052308

§ 371 (c)(1),
(2), (4) Date: Mar. 21, 2008

(87) PCT Pub. No.: WO2007/007262

PCT Pub. Date: Jan. 18, 2007

(65) Prior Publication Data

US 2008/0222081 A1 Sep. 11, 2008

Related U.S. Application Data

(60) Provisional application No. 60/698,238, filed on Jul. 11, 2005.

(51) Int. Cl.
*G09G 5/00* (2006.01)

(52) U.S. Cl.
USPC ..... 345/1.1; 345/1.2; 345/107; 345/204; 345/173; 361/679.01; 257/59; 359/296

(58) Field of Classification Search
USPC ..... 345/84, 174, 204, 107, 1.1, 1.2, 173; 361/679.01; 257/59, 660; 359/296
See application file for complete search history.

(56) References Cited

U.S. PATENT DOCUMENTS

| | | | | |
|---|---|---|---|---|
| 3,918,029 | A * | 11/1975 | Lemelson | 235/472.03 |
| 4,608,487 | A * | 8/1986 | Awane et al. | 235/383 |
| 5,572,651 | A * | 11/1996 | Weber et al. | 715/863 |
| 6,473,065 | B1 | 10/2002 | Fan | |
| 2002/0167474 | A1 | 11/2002 | Everitt | |
| 2003/0071804 | A1 | 4/2003 | Yamazaki | |
| 2005/0001812 | A1 * | 1/2005 | Amundson et al. | 345/107 |
| 2005/0024303 | A1 | 2/2005 | Kimura et al. | |
| 2005/0046747 | A1 * | 3/2005 | Park et al. | 348/569 |
| 2006/0004632 | A1 * | 1/2006 | Kelsen et al. | 705/14 |
| 2006/0077150 | A1 * | 4/2006 | Sampsell | 345/85 |

OTHER PUBLICATIONS

International Search Report for PCT/IB2006/052308 dated Jul. 23, 2007.

* cited by examiner

*Primary Examiner* — Lun-Yi Lao
*Assistant Examiner* — Shaheda Abdin

(57) ABSTRACT

A data structure (100) for formatting and storing properties of a visual display (210) is disclosed. The data structure (100) comprises a plurality of fields that include information relating to stable properties of a visual display (105, 110). The data structure (100) also includes at least one field that includes information relating to a changeable property of the display (145). Methods of using such a data structure (100) are also provided.

18 Claims, 9 Drawing Sheets

SYSTEM AND METHOD FOR IDENTIFICATION OF DISPLAYS

FIELD OF THE INVENTION

The disclosed systems and methods relate generally to the field of visual displays for computers and specifically to systems and methods for identifying and using operating parameters of such visual displays.

BACKGROUND

Human-computer interfaces for computing devices, especially mobile computing devices such as personal digital assistants (PDAs), personal information managers (PIMs), and cellular telephones, among other devices, typically include some type of visual display upon which a variety of information can be presented to a user. These visual displays commonly use a type of liquid crystal diode (LCD) and are backlit. Because of the need for backlighting, among other factors, the use of such displays can constitute a major, if not the most significant, source of power consumption for a mobile device.

Drawbacks related to power consumption requirements for displays have spurred development efforts for alternative displays, including displays using organic light emitting diodes (OLEDs) and electrophoretic displays using microparticles that can be arranged into patterns by applying an electric charge. Some types of these displays have the benefit of being bi-stable, meaning that an image formed on the display when a charge is applied remains visible even after current is discontinued. However, many of these types of displays include components that degrade over time or with use. Effects of such degradation can be addressed in some manner to help ensure that am image of acceptable quality can be formed on a display.

SUMMARY OF THE INVENTION

The following presents a simplified summary in order to provide a basic understanding and high-level survey. This summary is not an extensive overview. It is neither intended to identify key/critical elements nor to delineate scope. Its sole purpose is to present some concepts in a simplified form as a prelude to the more detailed description later presented. Additionally, section headings used herein are provided merely for convenience and should not be taken as limiting in any way.

A data structure for formatting and storing properties of a visual display, comprises a plurality of fields that include information relating to stable properties of a visual display and at least one field that includes information relating to a changeable property of the display. The changeable property can be a lifetime property such as a property related to degradation of at least one component the display or amount of time of operation of the display.

The data structure can store properties of a display that includes an organic light emitting diode. The display can additionally or alternatively include a bi-stable image layer or an electrophoretic image forming layer, among others. The data structure can be embodied in a carrier wave, stored in a memory for storing data for access by a process of a computer, or stored on a computer-readable medium such as a random access memory, a flash memory, a magnetic disk, a magnetic tape, an optical disk, an optical encoding, a read-only memory, a radio frequency identification tag, a programmable read-only memory, an erasable programmable read-only memory, and an electrically erasable programmable read-only memory. Additionally or alternatively, the data structure can be encoded into a shape of a portion of the visual display such as a foil or an edge.

A visual display comprises a substrate, a group of electronics supported by the substrate, an image layer electrically coupled to the group of electronics, and a display descriptor, wherein the display descriptor includes data that relates to a lifetime property of at least one of the image layer and the group of electronics. The lifetime property can be an expected useful life, an amount of time of operation, or a measure of degradation. The display descriptor can be implemented as a data structure or a unique identifier. The unique identifier can be derived from lifetime property information. The image layer can comprise an organic light emitting diode or an electrophoretic layer. The display descriptor can be included in a read-only memory such as flash memory, a radio frequency identification tag, an erasable programmable read-only memory, an optical storage device, or a barcode. When implemented as an optical storage device, the optical storage device can comprise a plurality of elements configured to selectively transmit light. At least a portion of the data of the display descriptor can be encoded into a shape of a portion of the visual display, such as a foil or an edge.

A method for using a visual display comprises accessing information relating to a lifetime property of a visual display and using the information to set at least one operational parameter of driving electronics associated with the visual display. Accessing information can include reading the information from a read-only memory, accessing an optical storage medium, interpreting a physical encoding, or using an identifier to locate the information in a data store. Using an identifier can include accessing a lookup table, accessing a database, or accessing a remote device.

An apparatus for use with a visual display comprises means for accessing information relating to a lifetime property of a visual display and means for using the information to set at least one operational parameter of driving electronics associated with the visual display. The means for accessing information can include means for reading the information from a read-only memory, means for accessing an optical storage medium, means for interpreting a physical encoding of the information, means for using an identifier to locate the information in a data store, or means for accessing a remote device. The means for using an identifier can include means for accessing a lookup table or means for accessing a database.

An apparatus for providing informational content to an electronic device, comprises a unique identifier that is associated with a display screen of an electronic device and driving electronics that are configured to provide the unique identifier to a content server. A content server can be associated with the apparatus. The content server can be configured to use the unique identifier to select content to be sent to the electronic device and further configured to send the content to the electronic device. Also, the content server can include an identification module configured to obtain the unique identifier. The identification module can be configured to access a data store that can include a preference associated with the unique identifier.

A docking station can also be associated with the apparatus for providing informational content to an electronic device. The docking station can be for providing at least a portion of a data communication pathway from the electronic device to the content server. The apparatus can also be associated with a proximity detector that is configured to determine whether the electronic device is within a data communication range of the content server.

A method for providing information to an electronic device comprises identifying a display associated with an electronic device by accessing information about the display and sending information to the electronic device for presentation on the display. Identifying a display can include accessing a unique identifier of the display. Sending information to the electronic device can include selecting the information based at least in part upon a characteristic of the display. Sending information can include determining proximity of the electronic device for data communication or using a docking station.

A system for providing information to an electronic device comprises means for identifying a display associated with an electronic device by accessing information about the display and means for sending information to the electronic device for presentation on the display. The means for identifying a display can include means for accessing a unique identifier of the display. The means for sending information to the electronic device can include means for selecting the information based at least in part upon a characteristic of the display, means for determining proximity of the electronic device for data communication, or a docking station.

A method for distributing electronic information comprises selecting information to write to a bi-stable display, writing the information to the bi-stable display, and distributing the bi-stable display. The bi-stable display can include at least one of an electrophoretic display component and a light-emitting display component. Selecting information to write can include using descriptive information of the bi-stable display. Using descriptive information of the bi-stable display can include using a unique identifier or using information about a lifetime property of the display. The information to write to the bi-stable display can be at least one type of information selected from the group consisting of business contact information, advertising information, and information relating to a displayed object. Also, the information to write to the bi-stable display can be at least one type of information selected from the group consisting of business contact information, advertising information, and information relating to a displayed object.

A system for distributing electronic information comprises means for selecting information to write to a bi-stable display, means for writing the information to the bi-stable display, and means for distributing the bi-stable display. The bi-stable display can include at least one of an electrophoretic display component and a light-emitting display component. The means for selecting information to write can include means for using descriptive information of the bi-stable display. The means for using the descriptive information of the bi-stable display can include means for using a unique identifier or means for using information about a lifetime property of the display. The information can be at least one type of information selected from the group consisting of business contact information, advertising information, and information relating to a displayed object.

DETAILED DESCRIPTION OF THE DRAWINGS

Figure 1:
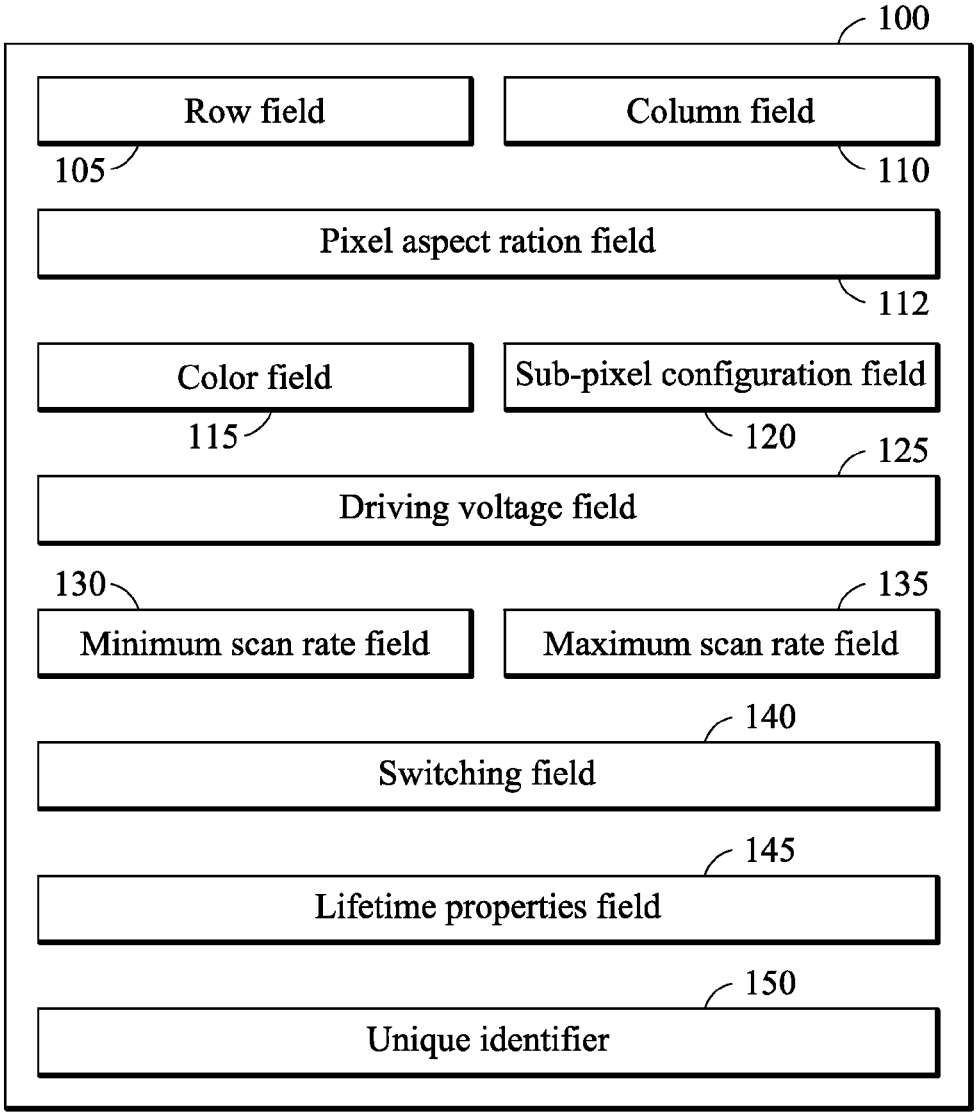
FIG. 1 is a record of a data structure.

The described systems and methods relate to design and use of visual displays. As used herein, the terms component, module, system, and similar terms are intended to refer to a computer-related item, such as hardware, software, firmware, or a combination of hardware, software or firmware. For example, a component or module can be a process running on a processor, a processor, an object, an executable, a program, or a computer. Also, both an application running on a server and the server itself can be components or modules. One or more components or modules can reside within a process. A component or module can be localized on one computer or distributed between or among two or more computers. A system can be a component or module of a larger system or can itself include one or more components or modules.

In descriptions to follow, components, modules, or systems may be described as interacting with each other in some fashion. For ease of understanding and clarity of explanation during such descriptions, components, modules, or systems may be described or depicted in drawings as directly connected to or with other components, modules, or systems. Such direct connections should be understood as including any necessary, sufficient, possible, appropriate, or conventional interfaces or intermediate components, modules, or systems where required.

Disclosed systems and methods are described with reference to the drawings. Like reference numerals are used to refer to like elements throughout. In the following description, for purposes of explanation, specific recited details are set forth to provide a thorough explanation. It may be evident, however, that some specific details may be changed or omitted entirely. Use of a disjunctive term listing, such as "A, B, or C" is not intended to exclude combinations of items listed in disjunctive form. In some examples, well-known structures or devices may, for ease and clarity of explanation, be shown in block diagram form. Additionally, although some specific examples may use terminology that is consistent with client-server architectures, or may even be examples of client-server implementations, skilled artisans will appreciate that the roles of client and server may be reversed, that implementation is not limited to client-server architectures and that an implementation may be readily adapted for use in other architectures, specifically including peer-to-peer (P2P) architectures.

FIG. 1 is a record of a data structure 100. The data structure 100 includes a group of fields, each of which includes information that can describe a property or attribute of a visual display. Among the types of displays with which use of the data structure 100 is contemplated are those displays that, for some reason or another, have properties that can change over time and affect quality of an image formed by or on the display. Specifically contemplated display types include OLED-based displays with either flexible or rigid substrates and electrophoretic displays such as microparticle-based displays (including bi-stable models) that are commonly called electronic ink displays, also with either flexible or rigid substrates. Displays that combine OLED and electrophoretic microparticle features are also included.

In the case of OLED displays, color components, especially blue and red components, degrade over time or with use. This degradation can be monitored. To a certain extent, driving electronics including associated software, if any, for the display can take such degradation into account and make appropriate adjustments for operation. In the simplest case, a display driver can detect when a display should be replaced based upon elapsed time of operation. In more complex cases, a display driver can adjust driving currents, sub-pixel configurations, or make other adjustments based upon specific properties of the display to minimize or eliminate degradation effects. Similar actions can be taken to deal with degradation aspects of electrophoretic or microparticle-based displays.

Displays that employ flexible substrates, such as those constructed using polymers or other suitable materials, are also subject to physical wear and tear from, among other things, being flexed and unflexed during use or between uses. Such flexing may also cause or contribute to degradation of display image quality and can also be taken into account when operating a display. A number of times a display has been flexed, for example, a count of how many times a display has been stored in a rolled-up position, or unrolled, can be tracked and used as a guide to estimate wear and tear or display degradation.

Electrophoretic displays can be manufactured using organic thin film transistors (OTFTs). Image-forming layers and thin film layers of these types of displays can degrade over time, even when not being used. Such displays can have a limited useful shelf life that can also be described with information that can be stored in the data structure 100.

The foregoing examples are illustrative scenarios of factors that can cause or contribute to degradation of images on a display or components of the display itself. The examples are not, and are not intended to be, an exhaustive or limiting list of factors. Those of ordinary skill in the art will readily recognize that other factors can exist depending upon a particular type or model of display used and that more than one factor can be present in a specific instance or implementation.

The data structure 100 includes a group of fields that can contain identifying or descriptive information relating to a feature or attribute of a display. In the example presented here, the display with which the data structure 100 is associated is pixellated. Each pixel includes sub-pixel components such as red, green, and blue color elements or some other image-forming element like a microparticle. A row field 105 can include a value that indicates a number of available rows of pixels that can be used to form an image. A column field 110 can include a value that indicates a number of available columns of pixels that can be used to form an image. For displays that are configured in a two-dimensional arrangement of rows and columns, information from the row field 105 and the column field 110 can be used as part of an addressing scheme to identify an individual pixel by its row and column values. A pixel aspect ration field 112 can include information regarding an aspect ratio of pixels of an associated display.

A color field 115 can include a value that indicates a number of colors that a display associated with the data structure 100 can support. The value in the color field 115 can be a direct indicator of a number of colors or shades of gray that the associated display can support. Alternatively, the value can be an encoded indicator that can be interpreted to obtain the number of colors or grays supported. A similar scheme can be used with other fields or subfields of the data structure 100 as well. A sub-pixel configuration field 120 can include information relating to specific configurations of components included in a pixel, such as red, green, and blue color components, among others.

A driving voltage field 125 can include information regarding properties of electric current, such as voltage, needed to operate the associated display or form images thereon. The information included in the driving voltage field 125 can be a baseline reference for use or modification by other components, can be information that was modified by another component, or can be both baseline and modification information. It should be appreciated that depending upon a specific implementation, the exact character, content, and format of this information, including formatting into one or more subfields of the driving voltage field 125, can vary.

A minimum scan rate field 130 and a maximum scan rate field 135 can include information about minimum and maximum scan rates of an associated display, respectively. A switching field 140 can include information about switching properties of a display effect of the associated display. Multiple subfields can be included in the switching field 140 to format information relating to multiple switching properties of a display. For example, a particular display may have different switching properties for different subpixel components. A specific display can also include more than one layer that is used to form an image and each layer can have one or more switching properties. The switching field 140 can include information for each component or layer.

A lifetime properties field 145 can also include multiple subfields for various pieces of information. Lifetime properties specifically include, but are not limited to, properties that relate to or describe a useful lifespan of a display. Also included are properties that can change or vary over the life of the display and properties that can describe wear and tear or degradation of the display. For example, a lifetime property can be an amount of time, such as a number of hours that a display is expected to be able to operate. Another lifetime property can be an actual amount of time a display has been operated. Still others include a measure of an amount of electric current that has been provided to the display; a count of a number of physical contact events, such as touches upon a touch-sensitive display; a count of a number of images that have been formed on the display; a count or counts of a number of times power has been cycled to the display or to individual pixels (or sub-pixels) of the display; and a count of a number of times (or a duration of time) the display has been flexed. Other properties will be apparent to those of ordinary skill in the art depending upon a specific implementation.

The data structure 100 can also include a unique identifier 150. The unique identifier 150 can be some identifying information that specifically identifies an individual display, such as a serial number. The unique identifier 150 can also be some code that can be derived from information about the display included in other fields of the display, such as lifetime properties of the display. Those of ordinary skill in the art will readily recognize from reading this disclosure that as an alternative to storing a derived identifier in a field of the data structure 100, a derived identifier can be dynamically created when needed.

Information stored in the data structure 100 can be accessed and used by display driving electronics, including both hardware and software components of such driving electronics. Depending upon application and implementation, the information can be used to derive other information for operating a display, for example, adjustments to voltages to be applied to display elements, or can simply be used to set operational parameters, such as a number of pixels available for use in forming an image and associated address boundaries of those pixels. This type of information can be especially useful when the device with which the display is used supports use of removable or replaceable displays. It should also be appreciated that other components, for example, counters, meters, and the like, can be used to create or use this information. These components can stand alone or be implemented as part of a display driver.

An example of use with replaceable displays follows. A mobile computing device can be sold with an original display that includes 1200 pixels in a 400×300 pixel configuration. Each pixel can support 256 shades of gray. The expected operational lifetime of the display is 10,000 hours. These properties are stored in appropriate fields of a data structure, such as the data structure 100 of FIG. 1, which itself is stored in an electrically erasable programmable read-only memory (EEPROM) that can be accessed by components of the mobile computing device. When the mobile computing device is operated, information about the display is read from the EEPROM and used by display driving components of the mobile computing device when forming images on the display.

The original display can be replaced with a display that includes 480,000 pixels in an 800×600 pixel configuration. Each pixel of the replacement display can support 64,000 colors. The expected operational lifetime of the replacement display is 5000 hours. These properties are similarly stored in appropriate fields of a data structure, such as the data structure 100 of FIG. 1, which itself is stored in an electrically erasable programmable read-only memory (EEPROM) that can be accessed by components of the mobile computing device. When the mobile computing device is operated with the replacement display, information about the display is read from the EEPROM by display driving components of the mobile computing device. Those display driving components can make appropriate adjustments to the configuration of the mobile computing device to enable the device to properly use the new display.

In another example, an original display includes a color component that steadily degrades as the display is used. The display has a useful life of 10,000 hours. One property of the degrading component is that negative effects of degradation can be addressed by increasing a voltage level to that component. A display driver can take information from the data structure 100 about power-on time of the display and use that information to adjust voltage to compensate for degradation of the component. At or near the end of the useful life of the display, the driver can trigger an indication that the display needs to be replaced.

Figure 2:
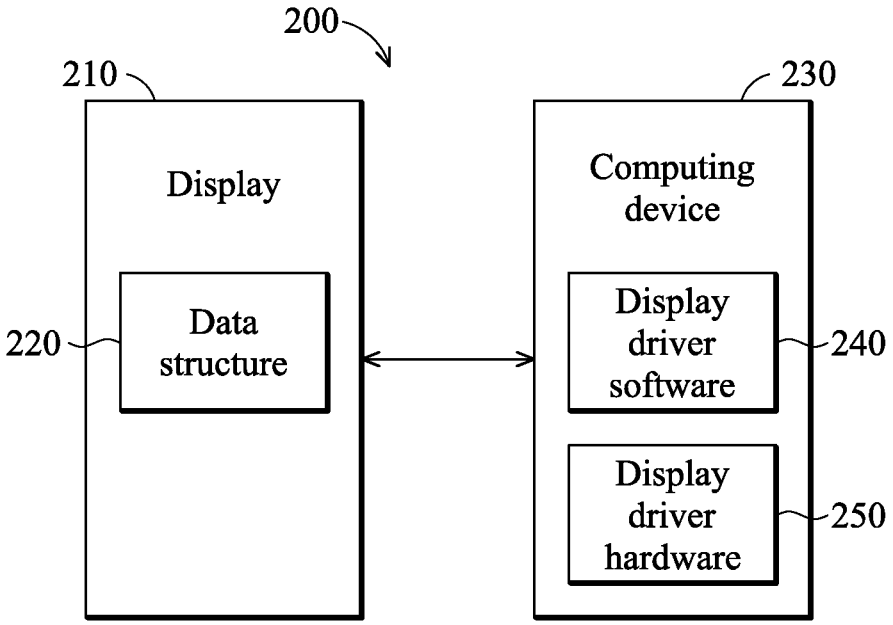
FIG. 2 is a system block diagram of a computing device system.

FIG. 2 is a system block diagram of a computing device system 200 that includes a display 210. The display can be any suitable visual display, specifically including displays that include electrophosphoretic image layers, electrophoretic or microparticulate image layers, a combination of electrophosphoretic and electrophoretic or microparticulate image layers, or some other suitable configuration. The term microparticulate includes, but is not limited to, a system that comprises charged, pigmented particles suspended in a medium that allows the particles to move within the medium in response to an applied electrical charge. Such a system can be implemented as a thin film layer to be applied to a substrate and is sometimes referred to as an electronic ink or electronic paper system.

The display 210 includes a data structure 220. A computing device 230 is coupled to the display 210 and includes display driver software 240 and display driver hardware 250. In operation, the display driver software 240 and display driver hardware 250 can access information in the data field 220 for use in causing the display 210 to form images.

The data structure 220 can be implemented as a data structure like the one described in conjunction with FIG. 1, or can be a variation of or complete deviation from that exemplary data structure. The data structure 220 can also be an identifier that uniquely identifies a specific display, a production run of a display model, a model of a display, a manufacturer of a display, or some other suitable descriptor of the display 210. Possible implementations of the data structure 220 include placing the data structure in a memory, such as a random access memory, a read-only memory (ROM), a radio frequency identification (RFID) tag, a programmable ROM (PROM), an erasable PROM (EPROM), an electrically erasable PROM (EEPROM), a flash memory unit, or another suitable memory. Other implementations can include the use of one or more resistors, capacitors, transistors, or fuses of which associated resistances, capacitances, parameters, or states, respectively, of such devices can indicate values of stored data.

Also contemplated are a variety of optical encodings such as one dimensional, stacked one dimensional, and two dimensional bar codes, or configurations that selectively admit, block, or reflect light, such as holes in an opaque substance, or the like. Further possibilities include physical structures that can encode information such as a physical shape of a foil or edge of a display component. Such structures can be used with or without cooperating structures that can be used to reduce the number of structures needed in a similar fashion to that employed by a multiplexer or multiplexers in a code generator to reduce the number of pins needed.

Figure 3:
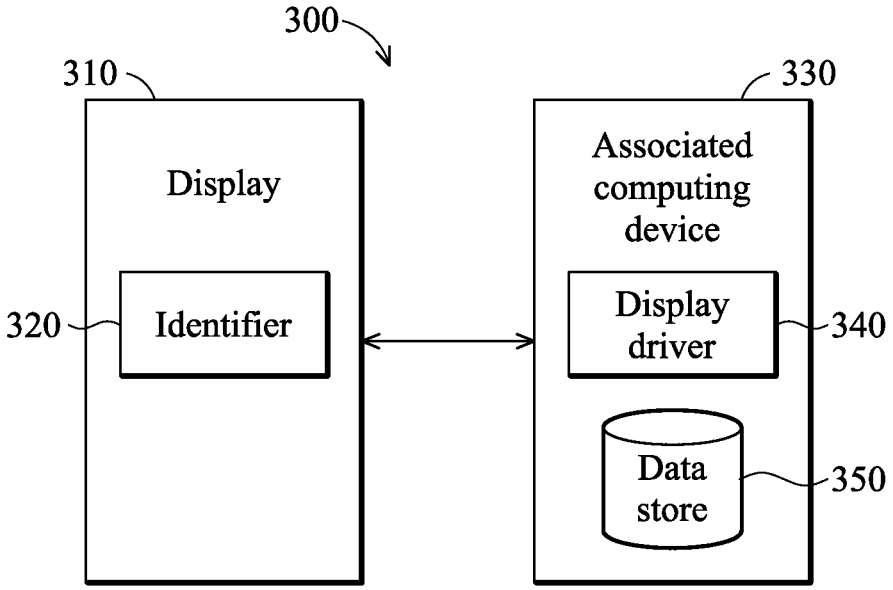
FIG. 3 is a system block diagram of a computing device system.

FIG. 3 is a system block diagram of a computing device system 300. The computing device system 300 includes a display 310 that includes an identifier 320. The display 310 can be any of the displays mentioned, described, or referenced above. The identifier 320 can be an appropriate identifier that uniquely describes a specific display, a production run of a display, a model of a display, a manufacturer of a display, or some other suitable descriptor of the display 310. Such appropriate identifiers can include numeric, alphanumeric, extended alphanumeric (for example, including symbols like tildes, ampersands, asterisks, and the like) binary, or hexadecimal identifiers, among others.

An associated computing device 330 includes a display driver 340 and a data store 350. The display driver 340 can include both software modules and hardware components. The data store 350 includes descriptive information about the display 310 and can also include descriptive information about other displays. A database, a flat text file, a structured data file, a data library, an object, or some other suitable means can be used as the data store 350. In this example, information of the data store 350 can be both read and written, thereby providing a means by which information can be updated, changed, or otherwise modified.

In operation, the display driver 340 can access the identifier 320 of the display 310. The display driver 340 can then use the identifier 320 as a key to obtain operational parameters of the display 310 from the data store 350. The device driver 340 can then use the obtained operational parameters to cause an image to be formed by the display 310.

Figure 4:
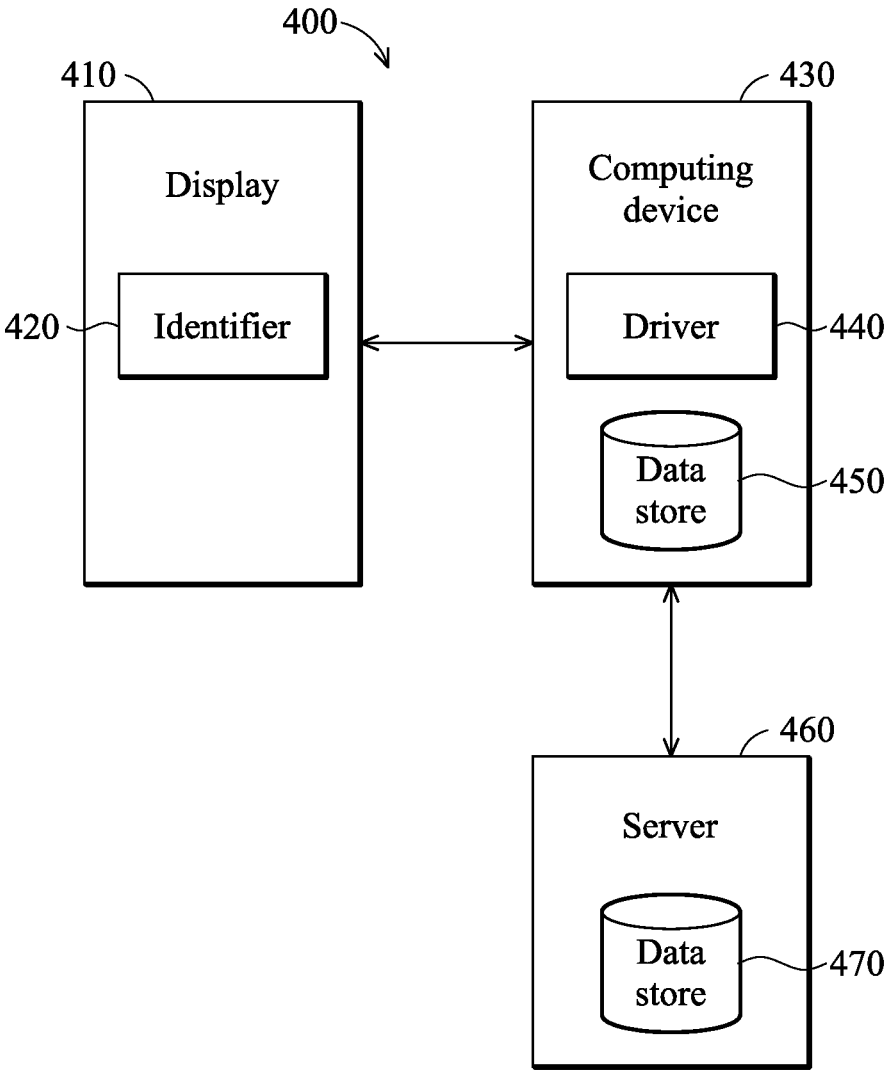
FIG. 4 is a system block diagram of a computing device system.

FIG. 4 is a system block diagram of a computing device system 400. The computing device system 400 includes a display 410 that itself includes an identifier 420. Both the display 410 and the identifier 420 can be implemented as previously described with reference to other figures. A computing device 430 includes a driver 440 and a data store 450. The data store 450 includes information about displays that the computing device 430 can use, such as the display 410.

A server 460 includes a data store 470 that includes operational information about displays that can be used by the computing device 430, such as the display 410. The server 460 is coupled to the computing device 430 by a data link. This data link can be a wired connection, for example, a telephone connection, a twisted pair connection, a coaxial cable connection, an Ethernet link, a universal serial bus (USB) connection, an IEEE 1394 (FireWire or iLink) connection, or another wired connection. A variety of optical data connections, like fiber optical cable connections, can also be employed to carry data signals between the computing device 430 and the server 460. Additionally, the data link can be wireless, such as a wireless network connection based upon communication protocols like code division multiple access (CDMA), time division multiple access (TDMA), global system for mobile communications (GSM), third generation (3G) protocols, IEEE 802.11x (WiFi), Bluetooth, WiMax, or another suitable wireless system.

In operation, the driver 440 of the computing device 430 accesses the identifier 420 of the display 410. The driver 440 uses information of the identifier 420 as a key to access appropriate operating parameters of the display 410 from the data store 450. If the data store 450 of the computing device 430 does not include information for the display 410, the computing device 430 sends a request, including information from the identifier 420, to the server 460 for information about the display 410. The server 460 uses the information from the identifier 420 to access the needed information from the data store 470. The server 460 transmits the needed information to the computing device 430 which stores the information in its data store 450. The driver 440 uses the information from the data store 470 of the server 460, a copy of which was stored in the data store 450 of the computing device 430, to cause the display 410 to form an image.

Figure 5:
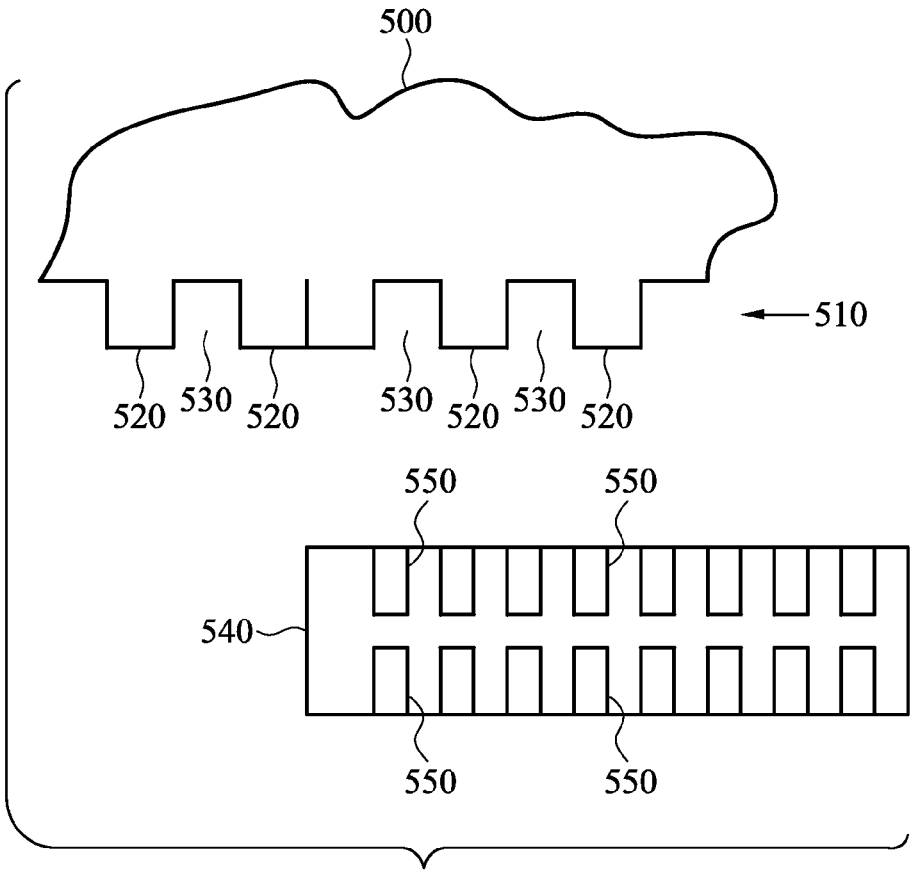
FIG. 5 is a perspective view of a portion of a foil and an associated connector.

FIG. 5 is a perspective view of a portion of a foil and an associated connector. The foil 500 includes a connection region 510 that includes a number of tabs 520 and notches 530. The tabs 520 are portions of the foil 500 that are configured to be inserted into a connector 540 and to come into electrical contact with corresponding pins 550 of the connector 540. Correspondingly, in areas of the foil 500 where a notch 530 is present, a pin 550 of the connector 540 will not create an electrical contact. Patterns of tabs 520 and notches 530 can be created to encode information, such as an identifier, or a data structure like the one described with reference to FIG. 1. A multiplexer or similar device can be used to reduce the number of tabs or notches needed to encode information. It should be appreciated that a greater or fewer number of tabs, notches, and pins than the number depicted in the figure can be used.

Figure 6:
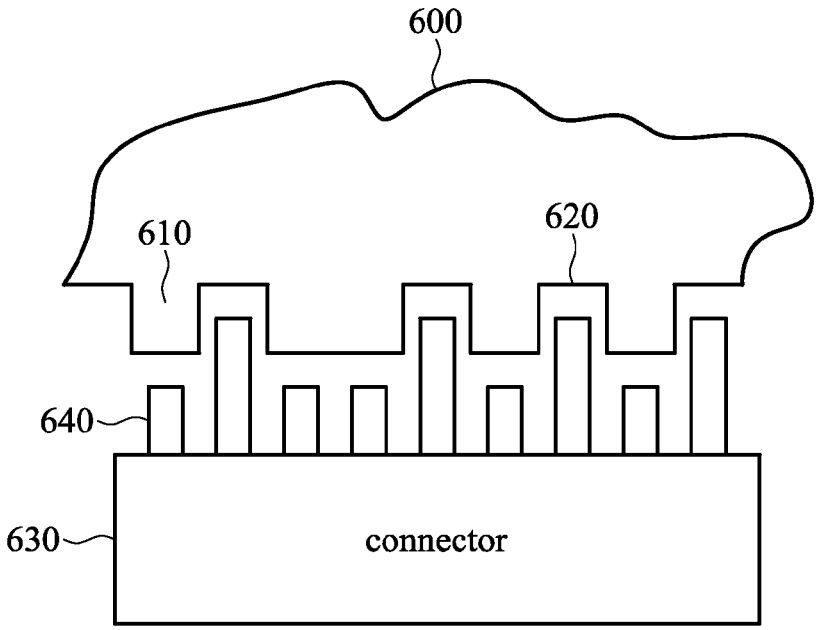
FIG. 6 is a perspective view of a portion of an edge of a display and an associated connector.

FIG. 6 is a perspective view of a portion of an edge of a display and an associated connector. The edge 600 of the display includes a region of tabs 610 and notches 620. Tabs 610 and notches 620 can be formed by selectively removing material from a region of the edge 600. By selectively removing such material, information like an identifier or other information can be encoded.

A connector 630 includes a number of pins 640. In this example, the pins 640 are configured such that each pin, when the connector 630 is not assembled with an edge 600, is urged into a protruding position by a type of spring mechanism (not shown). The spring mechanism can be an actual bent metal spring or some type of deformable resilient material. When the connector 630 is assembled with the edge 600, the notches 610 of the edge 600 come into contact with corresponding pins 640 of the connector 630 and cause such corresponding pins to be displaced from their original positions. When displaced, the pins make an electrical connection within the connector 630 that can be read and decoded to obtain the information encoded into the edge 600. As with other encoding schemes, a multiplexer or similar device can be used to reduce the number of tabs or notches needed to encode information, and correspondingly, the number of pins needed to effectively read such encoded information. It should be appreciated that a greater or fewer number of tabs, notches, and pins than the number depicted in the figure can be used.

Figure 7:
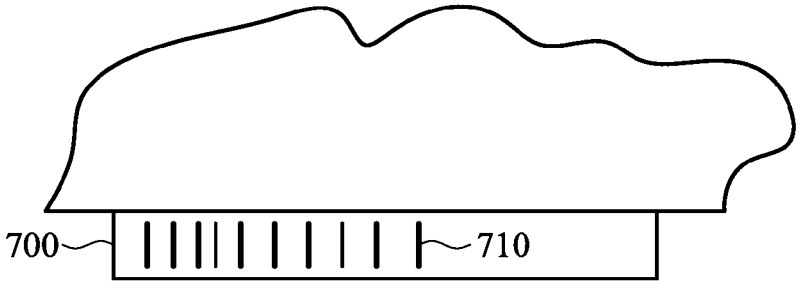
FIG. 7 is a perspective view of a portion of a display with optically encoded information.

FIG. 7 is a perspective view of a portion 700 of a display with optically encoded information. Information that can be encoded includes an identifier, such as any of the identifiers previously discussed in conjunction with other figures, or information of a data structure like the data structure described in conjunction with FIG. 1 and other drawings. The optically encoded information depicted in this example is in the form of a bar code 710. A one dimensional bar code is shown, but it should be appreciated that other types of bar codes, such as stacked one dimensional and two dimensional codes can be used. Bar codes of this type usually include black markings of various widths upon a white background. An optical scanner, such as a rasterizing laser scanner, can be used to decode the information of a bar code and communicate that data to an appropriate component of a computing device like a display driver. The optical scanner can be a separate component or can be incorporated into the computing device.

Figure 8:
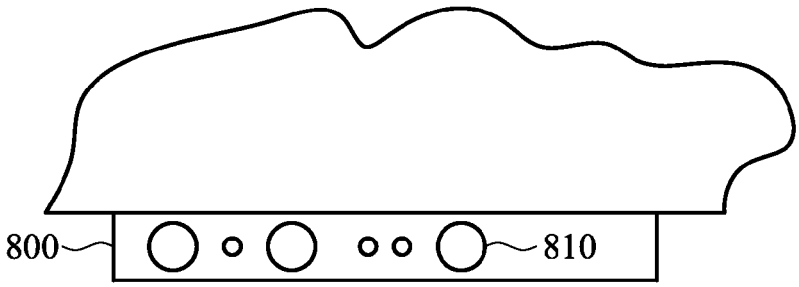
FIG. 8 is a perspective view of a portion of a display with optically encoded information.

FIG. 8 is a perspective view of a portion 800 of a display with optically encoded information. Information that can be encoded includes an identifier, such as any of the identifiers previously discussed in conjunction with other figures, or information of a data structure like the data structure described in conjunction with FIG. 1 and other drawings. The optically encoded information depicted in this example is in the form of a group of openings 810 through which light can pass. Each one of the group of openings 810 can be formed by removing material from the portion 800 of the display. As shown, openings can be of varying sizes. A light source, such as a light emitting diode, can be used to provide light to be transmitted through openings of the group of openings 810. A light detector, for example, a charge-coupled device (CCD), can be used to determine whether light has passed through an opening. Detected openings can represent data bits and can be decoded as described in conjunction with other drawings or by using another appropriate method.

Figure 9:
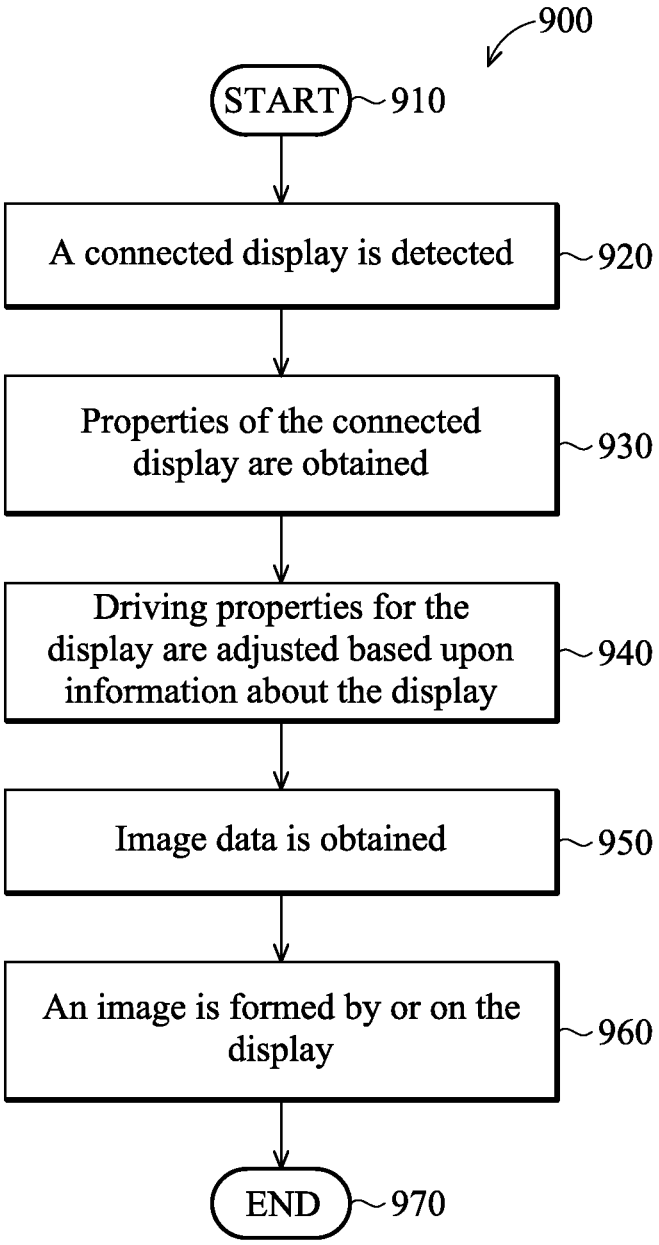
FIG. 9 is a flow diagram of a method that can be employed with systems, modules, or components described.
Figure 10:
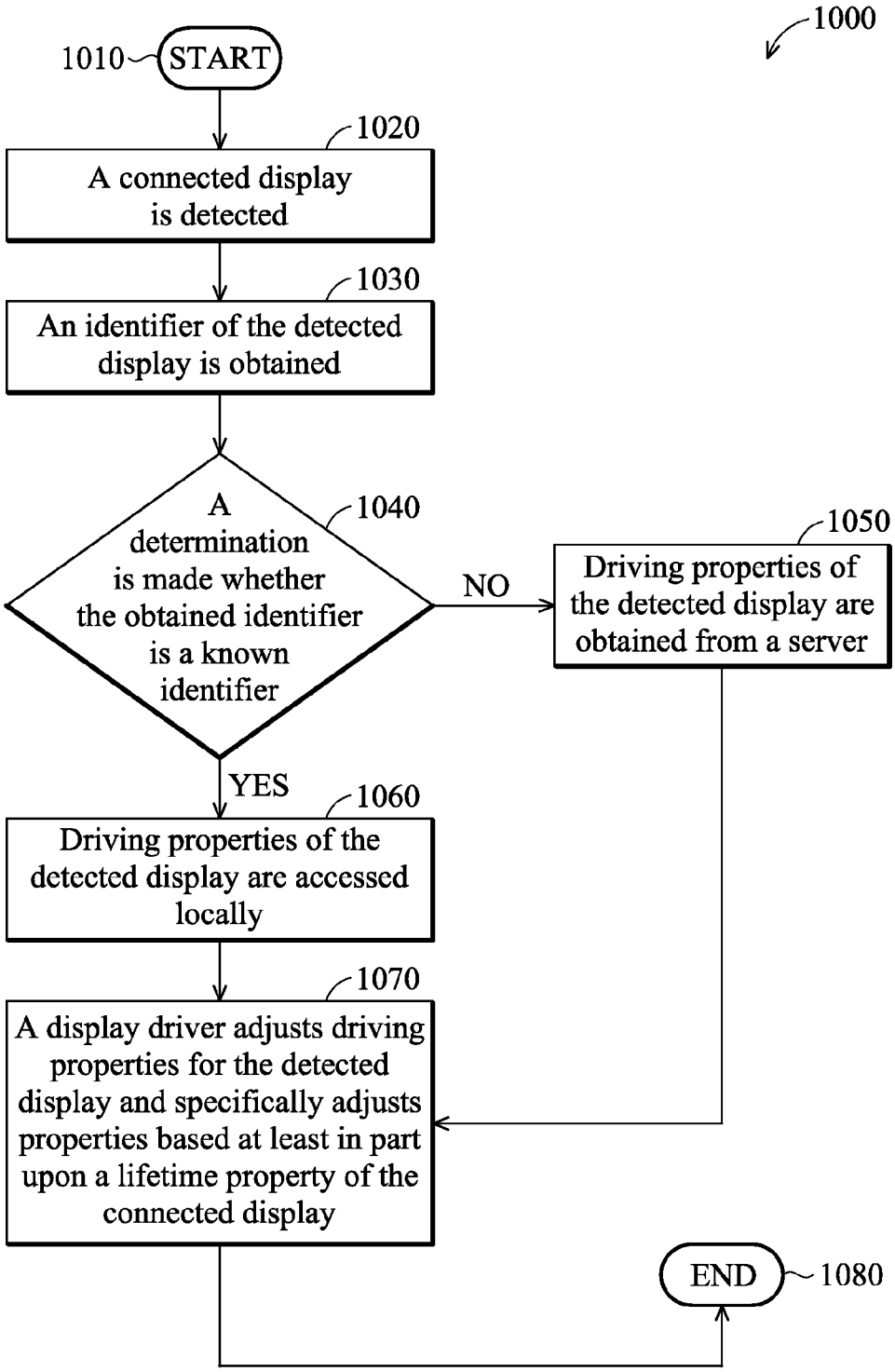
FIG. 10 is a flow diagram of a method that can be employed with systems, modules, or components described.

With reference to FIGS. 9-10, flow diagrams that depict processing of methods that can be employed with described systems, modules, or components are presented. For ease of explanation, the one or more methods depicted and described, for example, in conjunction with a flowchart, are shown and described as a series of acts or steps. It should be understood and appreciated that the described acts or steps may occur in a different order, in parallel or concurrently with other acts or steps, or with other modifications from what is shown and described herein. For example, those skilled in the art will understand and appreciate that a methodology could alternatively be represented as a series of interrelated states or events, such as in a state diagram. Moreover, not all illustrated acts may be required to implement a disclosed method.

FIG. 9 is a flow diagram of a method 900 that can be employed with systems, modules, or components described herein. Execution of the method 900 begins at START block 910 and continues to process block 920 where a connected display is detected. At process block 930, properties of the connected display are obtained. The properties can be obtained from a data structure associated with the connected display itself or by using an identifier of the display to obtain the information.

Processing continues at process block 940 where driving properties for the display are adjusted based upon information about the display, including information relating to lifetime properties of the display. At process block 950, image data is obtained. An image is formed by or on the display at process block 960. Processing terminates at END block 970.

FIG. 10 is a flow diagram of a method 1000 that can be employed with systems, modules, or components described herein. Execution of the method 1000 begins at START block 1010 and continues to process block 1020 where a connected display is detected. At process block 1030, an identifier of the detected display is obtained. At decision block 1040 a determination is made whether the obtained identifier is a known identifier. If no, processing continues at process block 1050 where driving properties of the detected display are obtained from a server. If yes, driving properties of the detected display are accessed locally.

Processing continues from either process block 1050 or process block 1060 at process block 1070. At process block 1070 a display driver adjusts driving properties for the detected display and specifically adjusts properties based at least in part upon a lifetime property of the connected display. Processing terminates at END block 1080.

Figure 11:
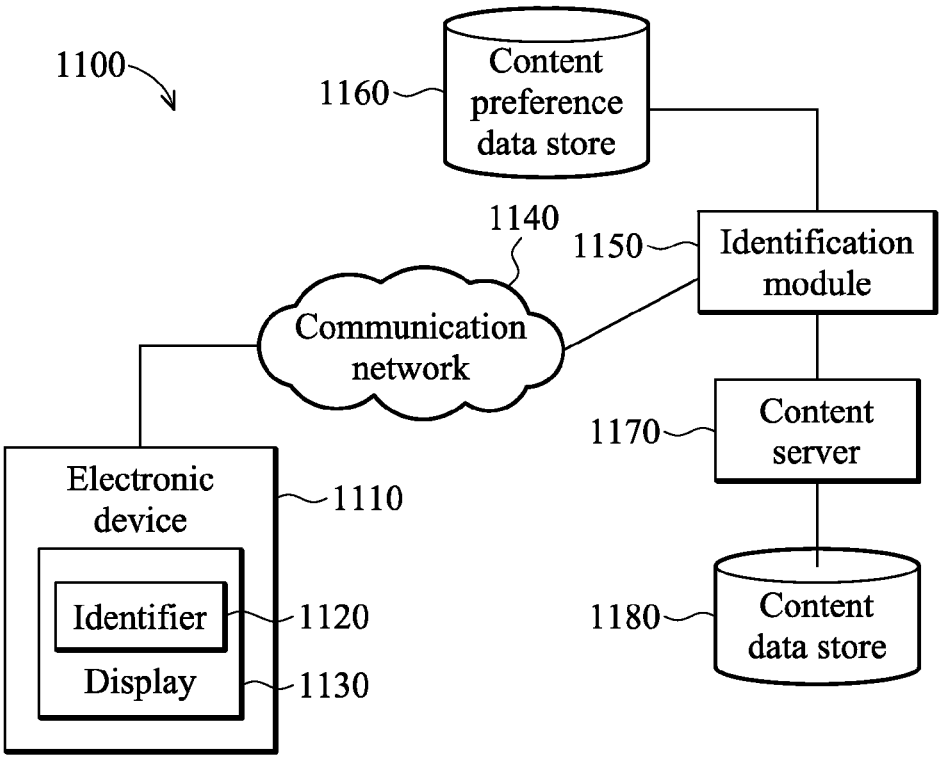
FIG. 11 is a system block diagram of a content delivery system.

FIG. 11 is a system block diagram of a content delivery system 1100. The content delivery system 1100 can be used to provide information in an electronic format that can be presented to a user on a display screen of an electronic device, such as a mobile computing device. Additionally, the content to be delivered can be selected on the basis of a unique identifier that is provided by a component of the electronic device.

The content delivery system 1100 includes an electronic device 1110. The electronic device 1110 can be any suitable electronic or computing device, specifically including a mobile computer, a PDA, a PIM, a gaming device, or a cellular telephone, among others. Also, the electronic device 1110 can be a special purpose device, such as a display screen with supporting electronics. Other types of electronic devices can also be used.

A display 1120 is included or associated with the electronic device 1110. The display 1120 can be any suitable form of display, including liquid crystal diode (LCD) displays, OLED displays, and electrophoretic displays, among others. The display 1120 includes or is associated with an identifier 1130. The identifier 1130 can be implemented as a data structure that is stored on a machine-readable medium, such as the data structure 100 disclosed and described in conjunction with FIG. 1. When implementing the identifier 1130 as a data structure like the data structure 100 of FIG. 1, the identifier 1130 can be a field within the data structure. Additionally or alternatively, the identifier 1130 can be a combination of information from fields of such a data structure or can be derived from information in such fields. The identifier 1130 can also be implemented as a code or other unique identifying data stored on some machine-readable medium such as a memory or radio frequency identification (RFID) tag, among others.

The electronic device 1110 can access a communication network 1140. The communication network 1140 can be any network that can support communication between or among electronic or computing devices. Contemplated networks include, but are not limited to, personal area networks (PANs), local area networks (LANs), wide area networks (WANs), intranets, and the Internet.

A data connection can also be substituted for the communication network 1140. Among the types of communication networks that can be used as the communication network 1140 are wired networks such as Ethernet, Token Ring, fiber optic, asynchronous transfer mode (ATM), integrated services digital network (ISDN), AppleTalk, and others. Also contemplated are wireless networks such as Bluetooth, IEEE 802.11x (WiFi), IEEE 802.16 (WiMax), code division multiple access (CDMA), time division multiple access (TDMA), global system for mobile communications (GSM), among others. Data connections that can be used include parallel, serial, universal serial bus (USB), IEEE 1394 (FireWire), advanced technology attachment (ATA), serial ATA (SATA), integrated drive electronics (IDE), peripheral component interconnect (PCI), PCIExpress, and ExpressCard, among others.

The communication network 1140 can carry data from the electronic device 1110 to an identification module 1150. The identification module 1150 can use identification information from the identifier 1130 to locate a content preference in a content preference data store 1160. The content preference can include an association between an identifier and content, such as a web page, an advertisement, a warning, a notice, textual information, graphical information, or another form of information. The content preference can also include implicit or explicit instructions regarding what content to send to the electronic device 1110.

The identification module 1150 can access a content server 1170 to obtain content for the electronic device 1110. The content server can use a content preference to retrieve content from a content data store 1180 in accordance with the content preference. The content data store 1180 can be any appropriate data store such as a text file, a structured text file, or a database, among others. The content server 1170 can send the retrieved content to the identification module 1150 to be forwarded over the communication network 1140 to the electronic device 1110. In this manner, information content can be provided to the electronic device 1110 based upon a unique identifying characteristic of the electronic device.

In operation, the content delivery system 1100 can function as follows. The electronic device 1100 connects to the identification module 1150 using the communication network 1140. The identification module 1150 retrieves the unique identifier 1130 from the electronic device 1110 and uses the unique identifier 1130 to obtain a corresponding content preference from the content preference data store 1160. The identification module 1150 sends the content preference it obtained to the content server 1170. The content server 1170 uses the content preference to retrieve content in accordance with the content preference from the content data store 1180. The content server 1170 sends the retrieved content to the identification module 1150 that sends the content to the electronic device 1110 using the communication network 1140.

Figure 12:
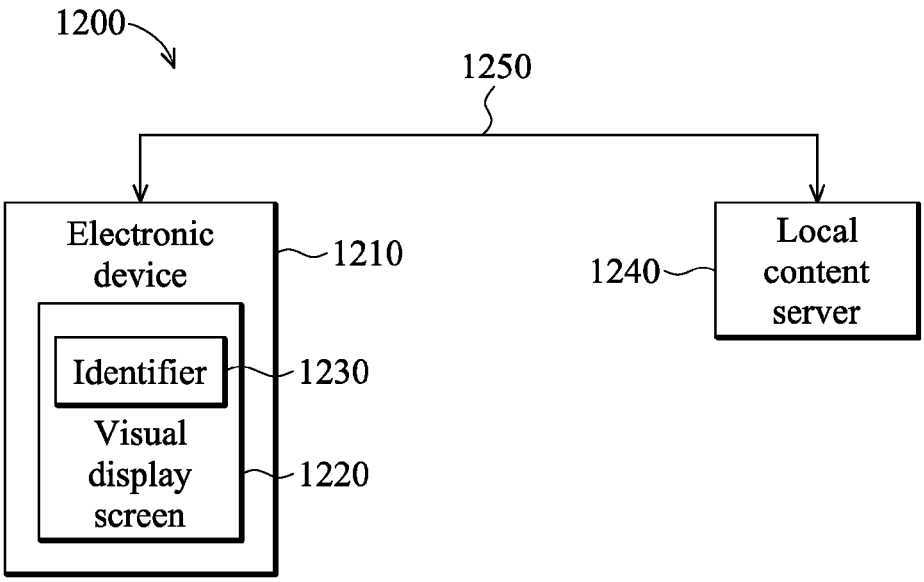
FIG. 12 is a system block diagram of an electronic content delivery system.

FIG. 12 is a system block diagram of an electronic content delivery system 1200. The content delivery system 1200 can be used to provide informational content in an electronic form to an electronic device that can display the informational content to a user. The informational content can include contact or other directory information, maps, advertisements, or promotional information for businesses, goods or services, among other things.

The electronic content delivery system 1200 includes an electronic device 1210. The electronic device 1210 can be a computing device such as a mobile computing device or a special purpose device that can support a visual display screen. A visual display screen 1220 is associated with the electronic device 1210. The visual display screen can be any of the visual displays disclosed or described in conjunction with other figures or can be another appropriate visual display. Specifically contemplated displays include LCD displays, OLED displays, and electrophoretic displays, especially those that are bi-stable.

An identifier 1230 is associated with the visual display screen 1220 and the electronic device 1210. The identifier 1230 can be a unique identifier that describes or is associated with information describing the display screen 1220, the electronic device 1210, or both. Possible implementations of the identifier 1230 include any of the implementations previously discussed in conjunction with other figures and specifically include a code stored in a machine-readable medium, a data structure, or another means.

The electronic device 1210 can communicate with a local content server 1240 by using a data connection 1250. The local content server 1240 can be any appropriate type of data server such as a web server, an FTP server, or a specially adapted or designed content server. It should be noted that although the term server is used in this example, other communication architectures, including peer-to-peer communications, among others. Additionally, in this and other examples, any appropriate communication protocol can be used, including, but not limited to, point to point protocol (PPP), transfer control protocol (TCP), user datagram protocol (UDP), Internet protocol (IP), and asynchronous transfer mode (ATM). The data connection 1250 can be any appropriate data connection, such as any of the data connections previously disclosed or described with reference to other figures, including both wired and wireless connections.

One example of the electronic content delivery system 1200 in operation follows. The electronic device 1210 uses the data connection 1250 to connect to the local content server 1240. The local content server 1240 obtains the identifier 1230 from the electronic device 1210. Using the identifier 1230, the local content server 1240 selects content and sends such content to the to the electronic device 1210. The electronic device 1210 presents received content on the display screen 1220.

It should be noted that in this example, and where appropriate or required by context in other examples, a wide range of uses of the identifier 1230 by the local content server 1240 is contemplated. At one end of a spectrum of possible uses, the local content server uses the identifier 1230 to uniquely identify a specific electronic device and selects customized content to send to that electronic device. Such customized content can be customized for the electronic device itself, as with the case of sending a graphical image at one resolution versus another, or can be customized for a user of the electronic device, such as with personalized content like web pages that identify individual visitors to the website or email messages for that user.

The local content server 1240 can be implemented in a static or dynamic fashion. Possible static implementations include implementations like web servers that deliver static HTML pages of FTP servers that deliver preexisting files, among others. Dynamic implementations include web servers that process server-side includes, servlets, and scripts, among others. It should be noted that such static and dynamic implementations can be employed not only in the context of the electronic content delivery system 1200, but also where suitable in conjunction with other systems disclosed or described herein.

At another end of the spectrum, the local content server 1240 uses the identifier 1230 merely as an indication that some device is requesting content and sends content in a form that the local content server 1240 presumes the electronic device 1210 can support. In such case, the same content can be sent to every electronic device that provides an identifier. Between these two ends can be use of the identifier 1230 as an indicator of a model or class of electronic devices that can be predefined to support certain types of content, for example, graphics, text, or animation, among others.

Those of ordinary skill in the art will readily recognize that many variations that are consistent with this scheme or are minor variations thereof are possible and such variations or variations are expressly contemplated. The electronic content delivery system 1200, as well as other systems can be put to a variety of specific uses. One such contemplated use is for shoppers carrying an electronic device, the electronic device can receive electronic coupons for items on display in a store or services provided by a merchant. Additionally or alternatively, the electronic device can receive additional information, such as price, ingredients, features, or technical specifications, among others, about the item or service.

Another possible use is in a museum. Patrons using electronic devices such as the devices disclosed and described herein can obtain information about works of art or other things on display. Additionally or alternatively, the information sent to the electronic device can include information about an artist who created a work or information about other works of that artist, among other things.

The electronic content delivery system 1200 can also be used at an information kiosk to provide a wide variety of informational services to users of electronic devices such as those disclosed and described herein. For example, a patron can obtain a map of a geographic area that can include navigation directions between or among points on the map. The patron can also obtain information regarding locations of local business establishments, goods or services provided by those establishments, and reviews of those goods or services. It should be noted that the preceding list is in no way exhaustive of the number of uses to which the electronic content delivery system 1200 can be put. Many other specific applications of the electronic content delivery system 1200 can be envisioned and many other types of content provided. The preceding list is exemplary only and should not be taken as limiting.

The electronic content delivery system can also be used in conjunction with a distribution system. For example, in a museum, a patron can purchase or borrow an electronic device for use in the museum. The electronic device can be made available at a kiosk, an information booth, at a display such as a shelf or rack, at a staffed booth. A distribution device such as a vending machine can also be used. An electronic device can also be mailed or delivered by a delivery service.

Figure 13:
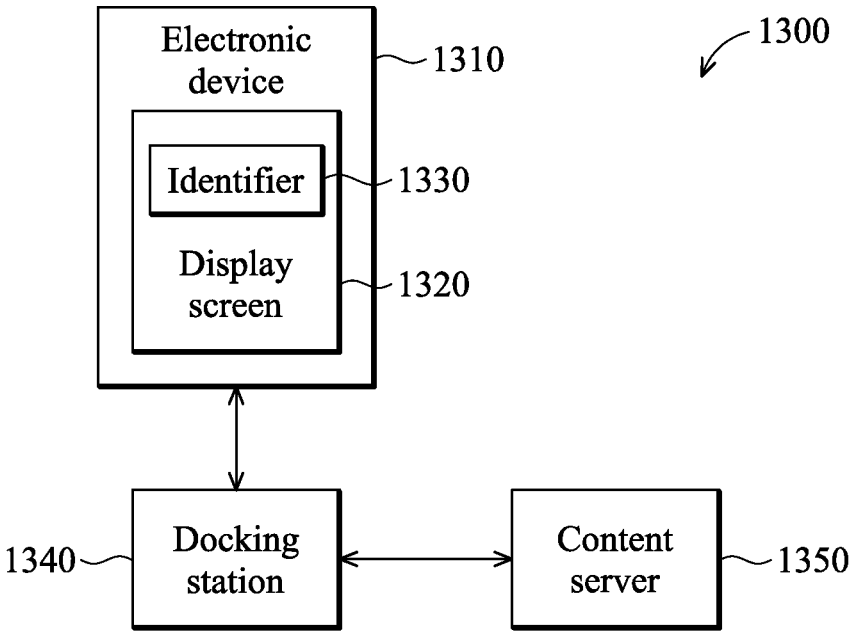
FIG. 13 is a system block diagram of an electronic content delivery system.

FIG. 13 is a system block diagram of an electronic content delivery system 1300. The electronic content delivery system 1300 can be used to provide information in a machine-readable format to electronic devices, especially special- or limited-purpose computing devices. Additionally, the electronic content delivery system 1300 can be used to perform certain maintenance or configuration functions on an electronic device.

The electronic content delivery system 1300 includes an electronic device 1310. The electronic device 1310 can be any of the electronic devices previously disclosed or described in conjunction with other figures. A display screen 1320 is coupled with the electronic device 1310 and can be any suitable display including, but not limited to, an LCD display, an OLED display, an electrophoretic display, or an electrophosphoretic display, among others. An identifier 1330 is associated with the display screen 1320. The identifier 1330 can be any of the previously disclosed or described identifiers or another suitable identifier.

A docking station 1340 accommodates the electronic device 1310 and can provide an interface for various functions of or for the electronic device 1310. Specifically, the docking station 1340 can support functions that can include, but are not limited to, charging or recharging batteries or otherwise replenishing, such as by replacing spent fuel in a fuel cell, a power source of the electronic device 1310, acting as a data conduit from a data source to the electronic device 1310, or other suitable functions. In one possible implementation, the docking station can act as an intermediate content storage system that holds content for the electronic device 1310 until the electronic device 1310 is connected to the docking station 1340, at which point the docking station 1340 can transfer stored content to the electronic device 1310. The docking station 1340 in that case can be paired with one or more electronic devices 1310 such that the docking station 1340 can prefetch information for multiple electronic devices.

Content can come from a content server 1350 that can be in data communication with the docking station 1340. The content server 1350 can be any of the types of servers disclosed or described with reference to other figures and specifically can include web servers, FTP servers, or content provision systems implemented using peer-to-peer communication architectures. Content from the content server 1350 can be any of the types of content previously disclosed or described, specifically including text, an image, or a motion picture, among others. It should be noted that although the docking station 1340 is shown as directly connected to the content server 1350, there can be intermediate connections, including network connections such as an intranet or the Internet, among others, between the docking station 1340 and the content server 1350.

The electronic content delivery system 1300, in one possible implementation, can operate as follows. The electronic device 1310 connects to the docking station 1340. The docking station 1340 recharges a battery or batteries of the electronic device 1310 while the electronic device 1310 is connected to the docking station 1340. The electronic device 1310 sends a copy of the information stored in its identifier 1330 to the docking station 1340 which forwards that copy to the content server 1350.

The content server 1350 uses the copy of the information from the identifier 1330 to obtain content to be sent to the electronic device 1310. The content server 1350 can obtain content that is specifically keyed to the identifier 1330, that is simply generic information that can be provided to any suitable device having an identifier, or is chosen in some other fashion. The content server 1350 sends the content to the docking station 1340 that relays the content to the electronic device 1310. Upon receipt of the content, the electronic device 1310 presents the content on the display screen 1320.

Another possible manner of operation of the electronic content delivery system 1300 is as follows. The electronic device 1310 connects with the docking station 1340. The docking station 1340 pairs with the electronic device 1310 by sending a copy of the information stored in the identifier 1330 to the docking station 1340. The docking station 1340 stores a copy of the information from the identifier 1330 of the paired electronic device 1310.

Upon command or upon a periodic schedule or some other triggering event, the docking station 1340 sends a copy of the identifier 1330 to the content server 1350. The content server 1350 uses the copy of the identifier 1330 to obtain content to be sent to the docking station 1340. That content is specifically keyed to the identifier 1330, is simply generic information that can be provided to any suitable device having an identifier, is customized for the electronic device 1310 or user of that device, or is chosen in some other fashion. The content server 1350 sends the content to the docking station 1340 where the content is stored. The docking station 1340 associates the content from the content server 1350 with the copy of the identifier 1330 so that content sent by the content server 1350 to the docking station 1340 for a specific electronic device 1310 can be provided to the correct electronic device 1310.

When the electronic device 1310 connects to the docking station 1340, a content exchange process between the electronic device 1310 and the docking station 1340 begins. The content exchange process can be a data synchronization process that can occur with or without supporting or complementary functions from the content server 1350. Additionally or alternatively, the content exchange process can simply be a wholesale replacement of data stored on the electronic device 1310 with data stored on the docking station 1340 that was sent from the content server 1350. When the electronic device 1310 receives the content from the docking station 1340, it stores the content for use. The display screen 1320 presents the content in a form that is viewable by a user.

Figure 14:
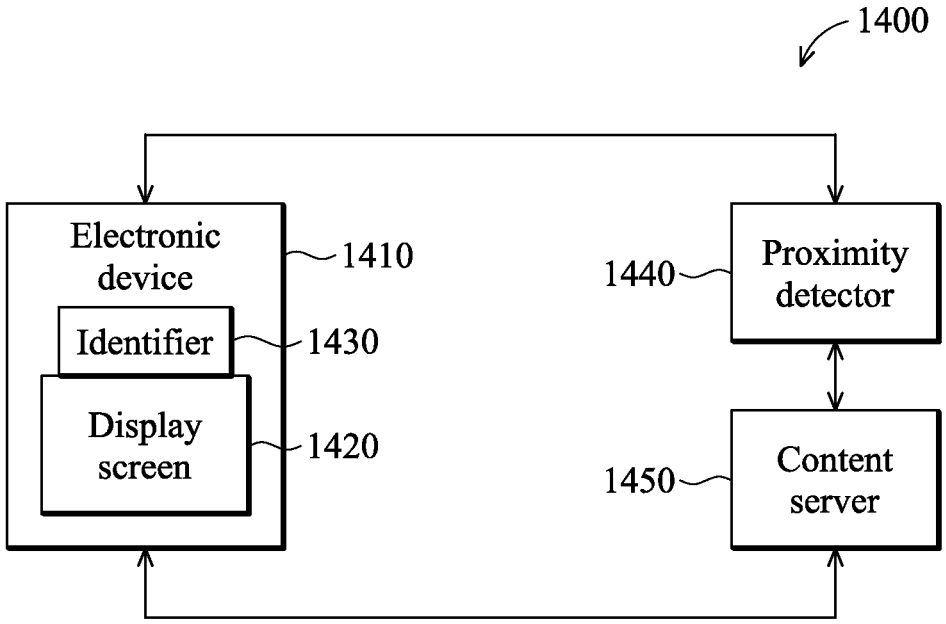
FIG. 14 is a system block diagram of a proximity-based content delivery system.

FIG. 14 is a system block diagram of a proximity-based content delivery system 1400. The proximity-based content delivery system 1400 can be used to deliver content to a mobile electronic device that enters into a certain range of a content server. Conversely, the content server can be mobile and deliver content to a stationary electronic device when the content server comes into range of the electronic device.

The electronic content delivery system 1400 includes an electronic device 1410. The electronic device 1410 can be any of the electronic devices previously disclosed or described in conjunction with other figures. A display screen 1420 is coupled with the electronic device 1310 and can be any suitable display including, but not limited to, an LCD display, an OLED display, an electrophoretic display, or an electrophosphoretic display, among others. An identifier 1430 is associated with the display screen 1420. The identifier 1430 can be any of the previously disclosed or described identifiers or another suitable identifier.

A proximity detector 1440 can detect when the electronic device 1410 is within a data communication range of a content server 1450. A variety of devices or systems can be used to detect proximity between the electronic device 1410 and the content server 1450. Among those devices or systems specifically contemplated are radio frequency identification (RFID) tag-based devices and systems and resonance label-based devices and systems. It should be noted that an RFID tag can be used in a dual capacity both as part of a proximity detection system and also to store information as an implementation of the identifier 1430.

Other types of proximity detection systems are also suitable for use. For example, a system that uses wireless data communications between the electronic device 1410 and the content server 1450 can use strength of a data signal, such as a data signal embodied with a radio carrier wave, as a measure of proximity of the devices to each other. Additionally or alternatively, other systems, for instance, a positioning system like the global positioning system (GPS) can be used to determine proximity. It should be noted that the proximity detector 1440 can be implemented to work in scenarios where the electronic device 1410 is mobile and the content server 1450 is stationary, where the electronic device 1410 is stationary and the content server 1450 is mobile, and where both the electronic device 1410 and the content server 1450 are mobile.

Content can come from the content server 1450 over a data communication path with the electronic device 1410. The content server 1450 can be any of the types of servers disclosed or described with reference to other figures and specifically can include web servers, FTP servers, or content provision systems implemented using peer-to-peer communication architectures. Content from the content server 1450 can be any of the types of content previously disclosed or described, specifically including text, an image, or a motion picture, among others.

In operation, the proximity-based content delivery system 1400 can function as follows. The electronic device 1410 is transported about an area within which it can be used. The proximity detector 1440 detects when the electronic device 1410 is within a preestablished range of the content server 1450. The proximity detector 1440 signals the electronic device 1410 to inform the electronic device 1410 that it is within data communication range of the content server 1450.

The electronic device 1410 initiates a data communication session with the content server 1450 by sending the identifier 1430 to the content server 1450. The content server 1450 uses the identifier 1430 to obtain content and sends that content to the electronic device 1410. Use of the identifier 1430 to obtain content can be as disclosed or described with reference to other figures or can be in accordance with some other appropriate method. In cases where content is customized or specified for a single device, among other appropriate cases, the content server can inform the electronic device 1410 that no content is available. The electronic device 1410 displays received content on the display screen 1420 for viewing by a user.

While the disclosed systems, modules, and components have been described in particular detail, it should be appreciated that numerous modifications are possible for those of ordinary skill in the art and wherever possible, should be viewed as fully within or consistent with descriptions in the claims. When interpreting the claims it should be understood that the word "comprising," or a form thereof, does not exclude the presence of other elements or limitations than those listed in a claim or portion of a claim; the word "consisting" excludes the presence of other elements or limitations than those listed in a claim or portion of a claim; the word "a" or "an" preceding an element or limitation means "one or more" and does not exclude the presence of a plurality of such elements. Additionally, any reference signs in the claims are exemplary only and do not limit their scope; and several "means" may be represented by the same item of hardware or software implemented structure or function. Specific examples presented herein are exemplary only and do not limit the scope of the claims.

The invention claimed is:

1. A flexible visual display screen, comprising:

a substrate;

a group of electronics supported by the substrate;

an image layer electrically coupled to the group of electronics; and a display descriptor, associated with the display screen, wherein the display descriptor includes data that relates to stable and lifetime properties of at least one of the image layer and the group of electronics, wherein the display descriptor is a unique identifier, and the unique identifier is a serial number arranged to uniquely identify the flexible visual display screen corresponding to the serial number, wherein the display descriptor is encoded into a plurality of tabs and notches of a portion of the display screen, the tabs and notches connect to a connector, and the shapes of the tabs and notches are used for indicating the display descriptor.

2. The display of claim 1, wherein the stable properties are related to one of pixel-configuration, color, driving voltage, scan rate and flexibility of the display.

3. The display screen of claim 1, wherein the lifetime properties are related to one of an expected useful life, an amount of time of operation, a measure of degradation, an amount of physical wear and tear, and a number of times of flexing of the display.

4. The display screen of claim 1, wherein the display descriptor is included in an optical storage device.

5. The display screen of claim 4 wherein the optical storage device is a barcode.

6. The display screen of claim 1, wherein the portion of the display is a foil.

7. The display screen of claim 1, wherein the portion of the display is an edge.

8. A display device, comprising the flexible visual display screen, according to claim 1;

driving electronics, associated with the display screen;

a computing device for accessing the display descriptor associated with the display screen and using the data, included in the display descriptor to set at least one operational parameter of the driving electronics.

9. The display device of claim 8, wherein the computing device further includes a storage device for storing data included in the display descriptor.

10. The display device of claim 8, wherein the computing device further includes means for interpreting a physical encoding of the data.

11. The display device of claim 8, wherein the computing device further includes means for using a unique identifier, included in the display descriptor to locate the data in one of a data store, a lookup table and a database.

12. A method for using a display device comprising a display screen, the display screen comprising a substrate, a group of electronics supported by the substrate and an image layer electrically coupled to the group of electronics, the method comprising:

accessing a display descriptor associated with the display screen, wherein the display descriptor includes data that relates to stable and lifetime properties of at least one of the image layer and the group of electronics; and using the data included in the display descriptor to set at least one operational parameter of driving electronics associated with the display screen, wherein the display descriptor is a unique identifier, and the unique identifier is a serial number arranged to uniquely identify the display screen corresponding to the serial number, wherein the display descriptor is encoded into a plurality of tabs and notches of a portion of the display screen, wherein the tabs and notches are configured to connect to a connector and shapes of the tabs and notches are used for indicating the display descriptor.

13. An apparatus for providing informational content to an electronic device, comprising:

a unique identifier that is associated with a display screen of an electronic device; and driving electronics that are configured to provide the unique identifier to a content server, wherein the unique identifier is a serial number arranged to uniquely identify the display screen corresponding to the serial number, wherein the display descriptor is encoded into a plurality of tabs and notches of a portion of the display screen, wherein the tabs and notches are configured to connect to a connector and shapes of the tabs and notches are used for indicating the display descriptor.

14. The apparatus of claim 13, further comprising a content server that is configured to use the unique identifier to select content to be sent to the electronic device and configured to send the content to the electronic device.

15. The apparatus of claim 14 wherein the content server includes an identification module configured to obtain the unique identifier.

16. The apparatus of claim 15, wherein the identification module is configured to access a data store that includes a preference associated with the unique identifier.

17. A method for distributing electronic information, comprising:

selecting information to write to a bi-stable display;

writing the information to the bi-stable display; and distributing the bi-stable display, wherein selecting information to write includes descriptive information of the bi-stable display, the descriptive information of the bi-stable display includes a unique identifier, and the unique identifier is a serial number arranged to uniquely identify the bi-stable display corresponding to the serial number, wherein the display descriptor is encoded into a plurality of tabs and notches of a portion of the display screen, wherein the tabs and notches are configured to connect to a connector and shapes of the tabs and notches are used for indicating the display descriptor.

18. The method of claim 17, wherein the descriptive information of the bi-stable display further includes information about a lifetime property of the display.

* * * * *

UNITED STATES PATENT AND TRADEMARK OFFICE

CERTIFICATE OF CORRECTION

PATENT NO. : 8,547,293 B2
APPLICATION NO. : 11/995480
DATED : October 1, 2013
INVENTOR(S) : Petrus Johannes Gerardus Van Lieshout et al.

It is certified that error appears in the above-identified patent and that said Letters Patent is hereby corrected as shown below:

On the title page item (73), should read:
Creator Technology B.V., Breda (NL)

Signed and Sealed this
Tenth Day of December, 2013

Margaret A. Focarino

Margaret A. Focarino
*Commissioner for Patents of the United States Patent and Trademark Office*